US008800421B1

(12) United States Patent
Colonnello

(10) Patent No.: US 8,800,421 B1
(45) Date of Patent: Aug. 12, 2014

(54) POSITIVE LOCKING MECHANISM FOR ROTATING HELICOPTER MOUNT

(71) Applicant: Michael Colonnello, Florham Park, NJ (US)

(72) Inventor: Michael Colonnello, Florham Park, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 65 days.

(21) Appl. No.: 13/687,469

(22) Filed: Nov. 28, 2012

Related U.S. Application Data

(60) Provisional application No. 61/659,165, filed on Jun. 13, 2012.

(51) Int. Cl.
*F41A 23/20* (2006.01)
*F41A 23/24* (2006.01)

(52) U.S. Cl.
CPC ..... *F41A 23/20* (2013.01); *F41A 23/24* (2013.01)
USPC ..... 89/37.11; 89/37.16

(58) Field of Classification Search
CPC ..... F41A 23/20; F41A 23/24; F41A 27/06; B64D 7/06
USPC ..... 89/37.01, 37.11, 37.16–37.22
See application file for complete search history.

(56) References Cited

U.S. PATENT DOCUMENTS 1,719,147 A * 7/1929 Tansley ..... 89/33.14
1,799,283 A * 4/1931 Coupland ..... 89/33.14
2,227,726 A * 1/1941 Laddon et al. ..... 89/37.16
2,252,079 A * 8/1941 Laddon et al. ..... 89/37.16
2,345,747 A * 4/1944 Hake ..... 89/37.16
2,354,114 A * 7/1944 Growald ..... 89/37.21
2,419,242 A * 4/1947 Woodberry et al. ..... 193/47
4,430,922 A * 2/1984 Fog et al. ..... 89/37.11
4,708,052 A * 11/1987 Argon ..... 89/41.01
5,263,397 A * 11/1993 Sanderson ..... 89/37.22
5,282,410 A * 2/1994 Sanderson ..... 89/37.16
6,250,196 B1 * 6/2001 Sanderson ..... 89/37.16
6,250,197 B1 * 6/2001 Sanderson ..... 89/37.16
6,283,428 B1 * 9/2001 Maples et al. ..... 248/282.1
6,286,411 B1 * 9/2001 Sanderson ..... 89/37.16
6,293,179 B1 * 9/2001 Sanderson ..... 89/37.03
6,439,098 B1 * 8/2002 Dillon ..... 89/34
6,729,592 B1 * 5/2004 Kurtts ..... 248/278.1
6,779,430 B1 * 8/2004 Sanderson ..... 89/33.16
6,799,500 B1 * 10/2004 Kulikowski ..... 89/34
7,258,055 B1 * 8/2007 Javorsky ..... 89/37.01
7,415,790 B1 * 8/2008 Ruhland et al. ..... 42/94
7,513,187 B1 * 4/2009 Lambermont ..... 89/37.07
7,543,524 B1 * 6/2009 Javorsky ..... 89/37.01
7,546,794 B1 * 6/2009 Sarles et al. ..... 89/34

(Continued)

*Primary Examiner* — Michael David
(74) *Attorney, Agent, or Firm* — Michael C. Sachs

(57) ABSTRACT

An apparatus for rotating and locking a first longitudinal member with respect to a second longitudinal member. One end of the first longitudinal member includes a locking mechanism having a generally arcuate outer surface with a plurality of deep and shallow notches formed therein. The notches correspond to different positions of rotation of the first and second members. One end of the second longitudinal member includes a yoke rotatably connected to the locking mechanism with a pivot pin. A locking plunger in the second longitudinal member engages the notches in the locking mechanism and is translatable between fully locked and fully unlocked positions. In the fully locked position, the first and second members are not rotatable with respect to each other.

11 Claims, 8 Drawing Sheets

(56) References Cited

U.S. PATENT DOCUMENTS

| | | | | |
|---|---|---|---|---|
| 7,780,026 | B1 * | 8/2010 | Zuckerman | 220/23.4 |
| 7,963,205 | B1 * | 6/2011 | Brooks | 89/37.03 |
| 8,151,684 | B2 * | 4/2012 | Buechler et al. | 89/33.2 |
| 8,336,441 | B1 * | 12/2012 | Javorsky | 89/37.03 |
| 2006/0273125 | A1 * | 12/2006 | Bogoslofski et al. | 224/509 |
| 2009/0094769 | A1 * | 4/2009 | Wilson | 15/144.1 |

* cited by examiner

POSITIVE LOCKING MECHANISM FOR ROTATING HELICOPTER MOUNT

STATEMENT OF GOVERNMENT INTEREST

The inventions described herein may be manufactured, used and licensed by or for the United States Government.

CROSS-REFERENCE TO RELATED APPLICATIONS

The present application claims the benefit of priority of U.S. provisional patent application Ser. No. 61/659,165 filed on Jun. 13, 2012, which is incorporated by reference herein.

BACKGROUND OF THE INVENTION

The invention relates in general to a rotatable mounting apparatus and in particular to a rotatable mounting apparatus for a gun.

A machine gun mount may be used to support and mount a machine gun. The machine gun may be, for example, an M240H machine gun. The machine gun may be mounted to or on a structure. The structure may be, for example, a helicopter, such as a CH47 Chinook helicopter. A helicopter or other structure may include doors and windows. The machine gun mount may be used to mount the machine gun at a door or window. In a CH47 Chinook helicopter, for example, machine guns may be mounted at multiple locations. The multiple locations may include a door and a window.

An example of a mount that may be used with a machine gun is disclosed in U.S. patent application Ser. No. 12/949,270 filed on Nov. 18, 2010 and entitled "Rotatable Gun Mount." U.S. patent application Ser. No. 12/949,270 has the same assignee as the instant patent application. The entire contents of U.S. patent application Ser. No. 12/949,270 are expressly incorporated by reference herein.

In some cases, it is desirable for a rotatable gun mount to have a greater range of movement than the mount shown in patent application Ser. No. 12/949,270. For example, both inboard and outboard rotation of the gun mount may be desired. In addition, a mechanism that enables faster and simpler articulation of the gun mount between multiple locking positions would be an advantage.

SUMMARY OF INVENTION

One aspect of the invention is an apparatus for rotating and locking a first longitudinal member with respect to a second longitudinal member. The first longitudinal member has a central axis and, on one end, a locking mechanism. The locking mechanism includes a through hole with a central axis that defines a pivot axis of the apparatus. The pivot axis is orthogonal to the central axis of the first longitudinal member. The locking mechanism has a generally arcuate outer surface with a plurality of notches formed therein. The plurality of notches includes deep notches and shallow notches.

The second longitudinal member has a yoke on one end. The yoke includes through holes. A pivot pin is disposed in the through hole in the locking mechanism and the through holes in the yoke to rotatably fix the first longitudinal member to the second longitudinal member. A locking plunger is disposed in the second longitudinal member and translatable between a fully locked position and a fully unlocked position. The locking plunger is biased toward the locking mechanism and includes a projection that (a) engages a first deep notch on the locking mechanism in the fully locked position, (b) engages a shallow notch on the locking mechanism in a force-dampening position, and (c) does not engage the locking mechanism in the fully unlocked position.

An operating pin is inserted through the second longitudinal member and the locking plunger for translating the locking plunger between the fully locked and the fully unlocked positions. The operating pin includes a central shaft and a collar disposed around the central shaft. The collar is biased toward the second longitudinal member. An operating pin opening is formed in the second longitudinal member for receiving the operating pin. The opening includes fully locked, transition, and fully unlocked portions. The fully locked and fully unlocked portions are large enough to receive the collar of the operating pin. The transition portion is large enough to receive the central shaft of the operating pin but not large enough to receive the collar of the operating pin.

In one embodiment, when the projection engages the first deep notch on the locking mechanism in the fully locked position, the first and second longitudinal members are collinear and the collar of the operating pin is disposed in the fully locked portion of the operating pin opening in the second longitudinal member.

In some embodiments, when the projection engages the shallow notch in the locking mechanism in the force-dampening position, the central shaft of the operating pin is disposed in the transition portion of the operating pin opening in the second longitudinal member.

The first and second longitudinal members may be arms and the first arm may include a pintle and a gun cradle fixed to the pintle.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

Figure 1:
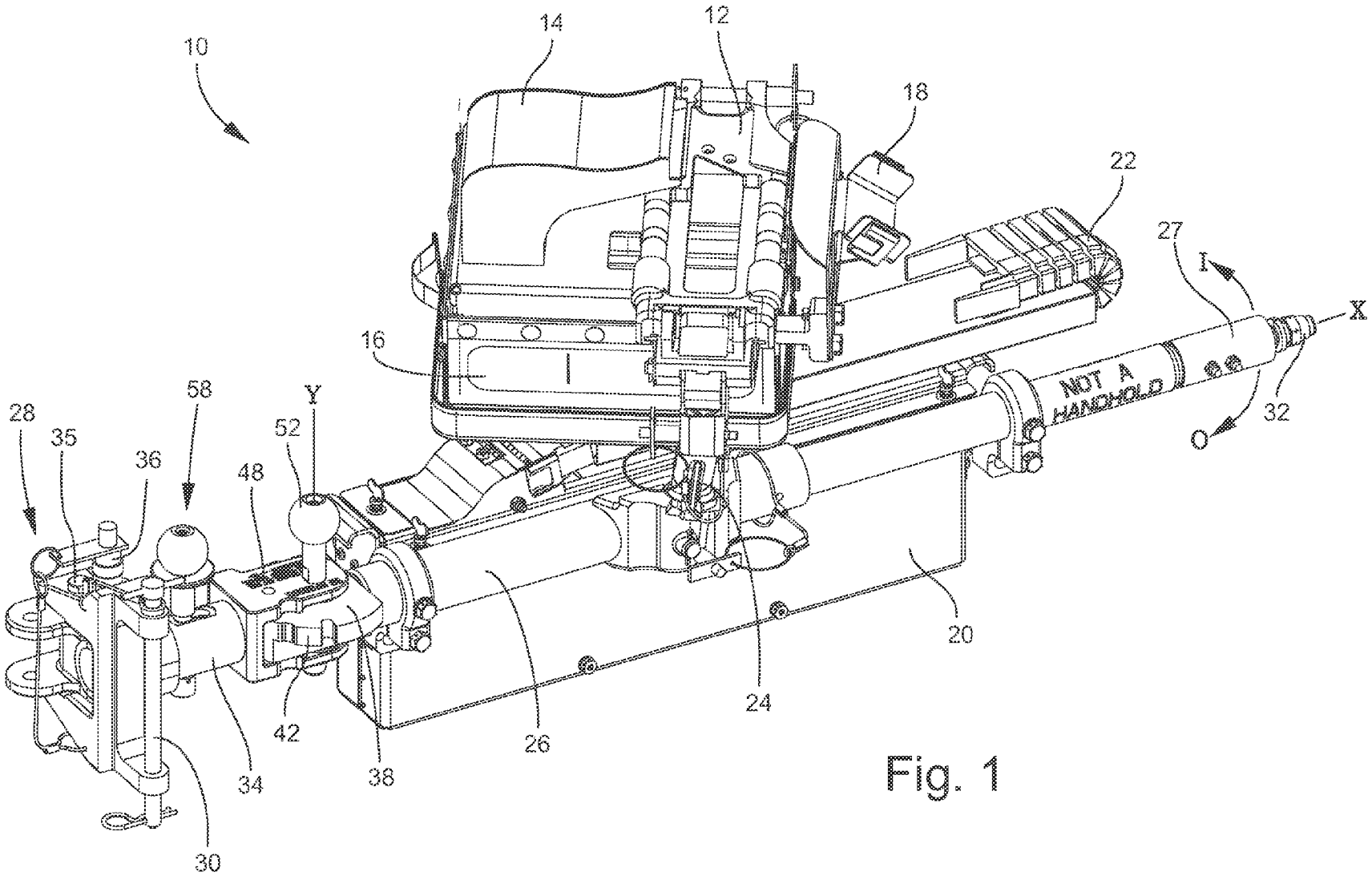
FIG. 1 is a perspective view of one embodiment of a gun mount.

FIG. 1 is a perspective view of an embodiment of a gun mount 10. Gun mount 10 may be used, for example, to mount a gun in an opening, such as a door or window, in a structure. The structure to which mount 10 is fixed may be mobile or immobile. Mobile structures may include air, land, space, and sea vehicles. Immobile structures may include buildings, for example.

A gun (not shown) may be mounted on a gun cradle 12. One side of the gun may interact with a spent case collector 14 that leads to a spent case and link storage container 16. Container 16 may be supported by cradle 12. Another side of the gun may interact with a magazine feed mechanism disposed at area 18. In the embodiment of FIG. 1, a bar-mounted ammunition container 20 may supply ammunition to the gun in mount 10 via a flexible chute 22. Gun cradle 12 may be fixed to a pintle 24. As is known in the art, gun cradle 12 is movable in azimuth and elevation on pintle 24. Pintle 24 may be fixed to and supported by a longitudinal member or arm 26 having a central longitudinal axis X.

One end of mount 10 may include a hinge assembly 28. Hinge assembly 28 may include a mounting pin 30 for fixing mount 10 to a suitable bracket located on one side of an opening in a structure. Another longitudinal member or arm 34 may be fixed to hinge assembly 28 using, for example, pins 35 and 36. A detailed embodiment of hinge assembly 28 is disclosed in U.S. patent application Ser. No. 12/949,270. The other end of mount 10 may include a support member 32. Support member 32 may be fixed to a side of the opening in the structure opposite the side where hinge assembly 28 is fixed such that mount 10 spans across the opening in the structure. An end 27 of arm 26 may include a bushing that allows end 27 to disengage from support member 32 and thereby allow arm 26 to rotate in the directions I and O shown in FIG. 1.

Figure 3A:
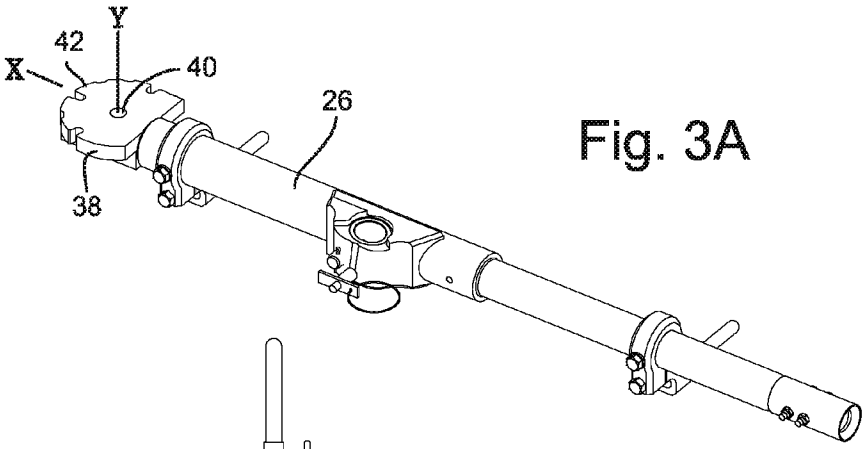
FIG. 3A is a perspective view of an arm and locking mechanism of the mount of FIG. 1.
Figures 4A, 4B, 4C, 4D, 4E:
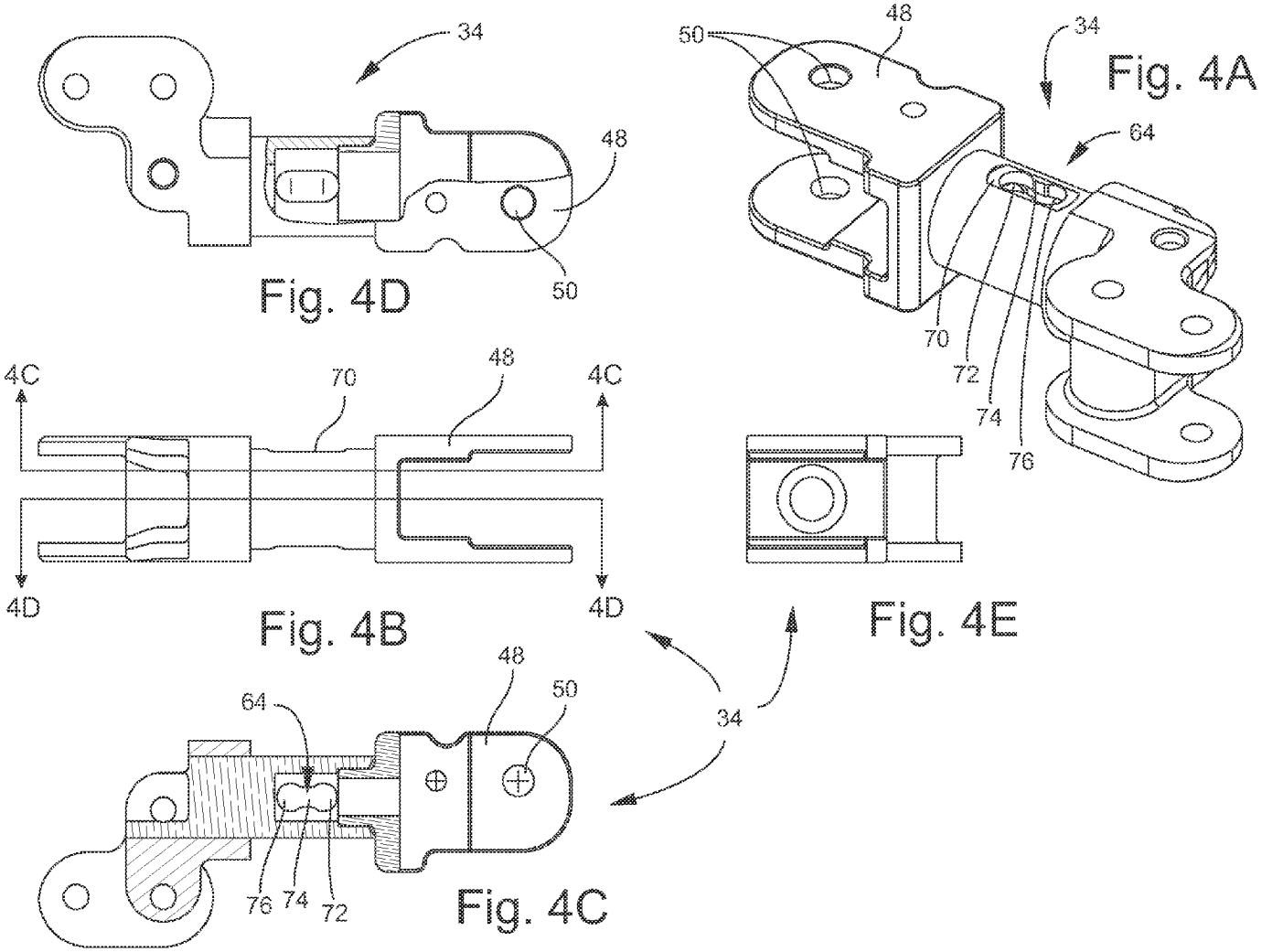
FIG. 4A is a perspective view of another arm of the mount of FIG. 1.
FIG. 4B is a side view of FIG. 4A viewed from the opposite side of the view in FIG. 4A.
FIG. 4C is a bottom view of FIG. 4B, fully in section, with the sectioned portion taken along the line 4C-4C of FIG. 4B.
FIG. 4D is a top view of FIG. 4B, fully in section, with the sectioned portion taken along the line 4D-4D of FIG. 4B.
FIG. 4E is an end view of FIG. 4B.
Figure 5A:
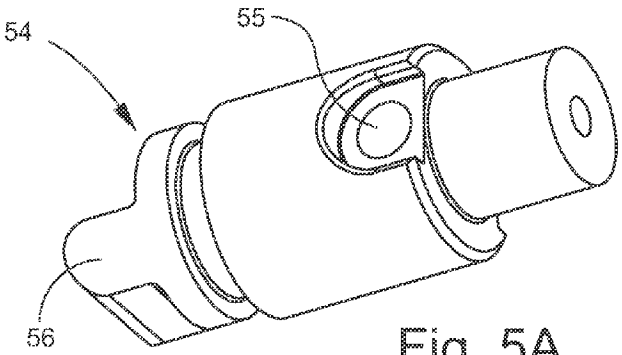
FIG. 5A is a perspective view of a locking plunger of the mount of FIG. 1.
Figure 5B:
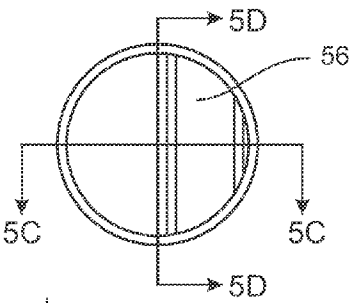
FIG. 5B is an end view of the left hand end of FIG. 5A.
Figure 5C:
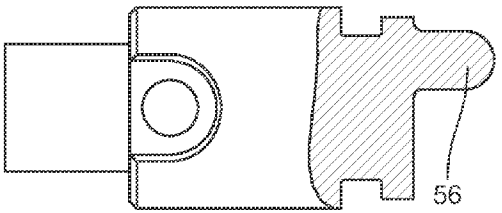
FIG. 5C is a top view of FIG. 5B, partially sectioned along the line 5C-5C of FIG. 5B.
Figure 5D:
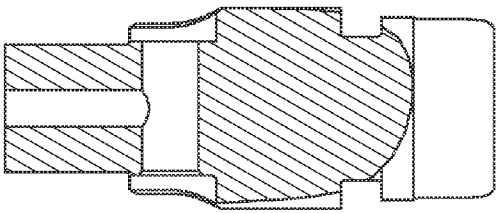
FIG. 5D is a side view of FIG. 5B, partially sectioned along the line 5D-5D of FIG. 5B.
Figure 5E:
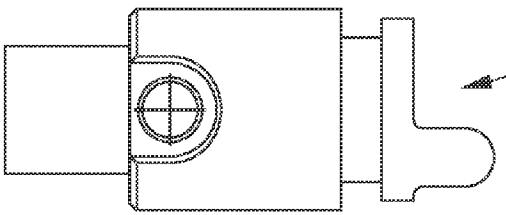
FIG. 5E is a bottom view of FIG. 5D.
Figure 5F:
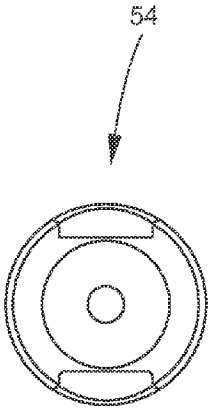
FIG. 5F is an end view of the right hand end of FIG. 5A.

Arm 26 is rotatable with respect to arm 34 and may be locked in various positions of relative rotation. Arm 26 includes a locking mechanism 38 on one end. Locking mechanism 38 includes a through hole 40 (FIG. 3A) with a central axis that defines a pivot axis Y of arms 26 and 34. Pivot axis Y is orthogonal to central axis X of arm 26. Locking mechanism 38 includes a generally arcuate outer surface 42 with a plurality of notches 44*a*, 44*b*, 44*c*, 46 formed therein. The number, location, size, and depth of notches 44*a*, 44*b*, 44*c*, and 46 may vary, depending on the requirements of a particular application. In the embodiment shown in FIG. 3A, notches 44*a*, 44*b*, 44*c* are deep notches and notches 46 are shallow notches. Referring to FIG. 1, arm 34 includes a yoke 48 on one end. Yoke 48 includes through holes 50 (FIG. 4A). A pivot pin 52 is disposed in through hole 40 in locking mechanism 38 and in through holes 50 in yoke 48 to rotatably fix arm 26 to arm 34.

Figure 2A:
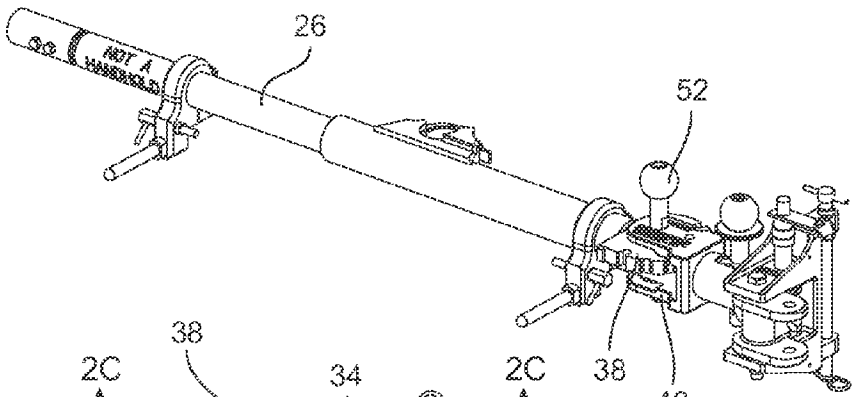
FIG. 2A is a perspective view of the arms and hinge assembly of the gun mount of FIG. 1.
Figure 2B:
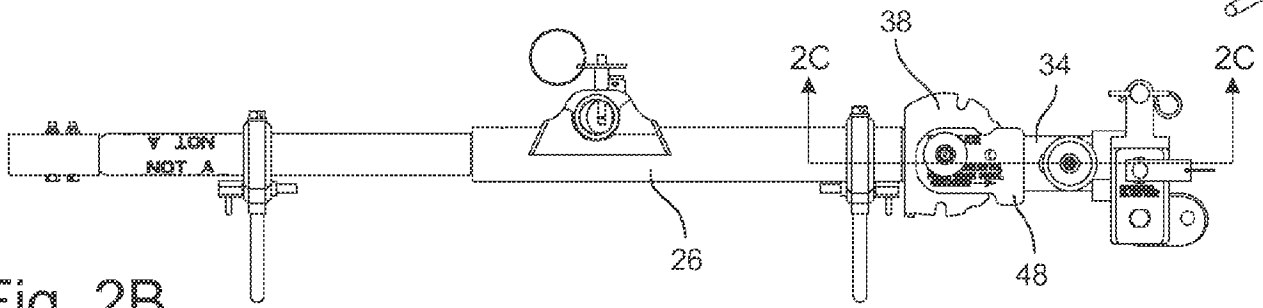
FIG. 2B is a top view of FIG. 2A.
Figure 2C:
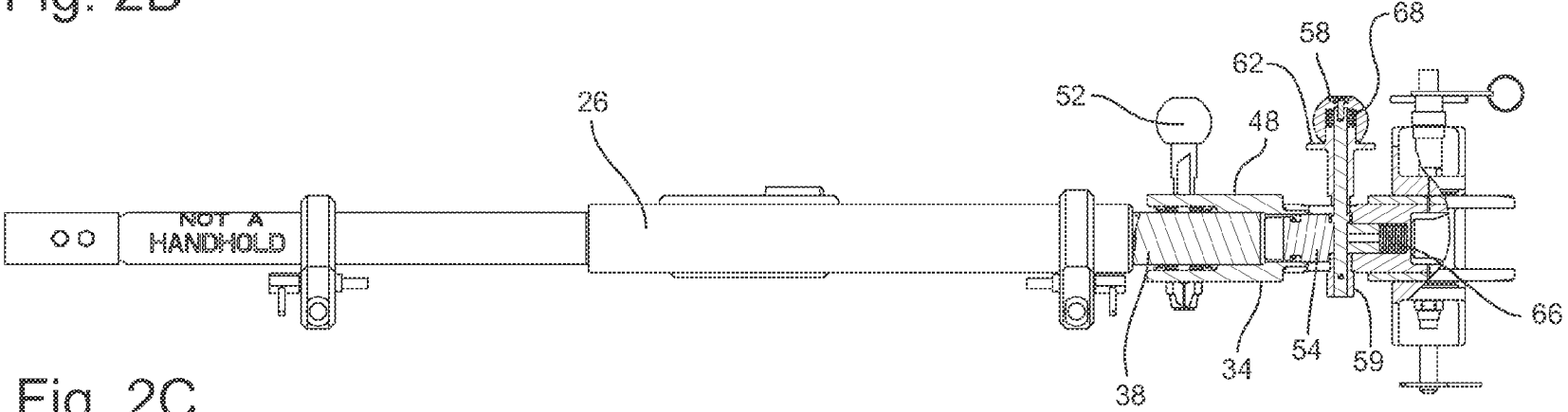
FIG. 2C is a side view, partially in section, of FIG. 2B, with the sectioned portion taken along the line 2C-2C of FIG. 2B.
Figure 2D:
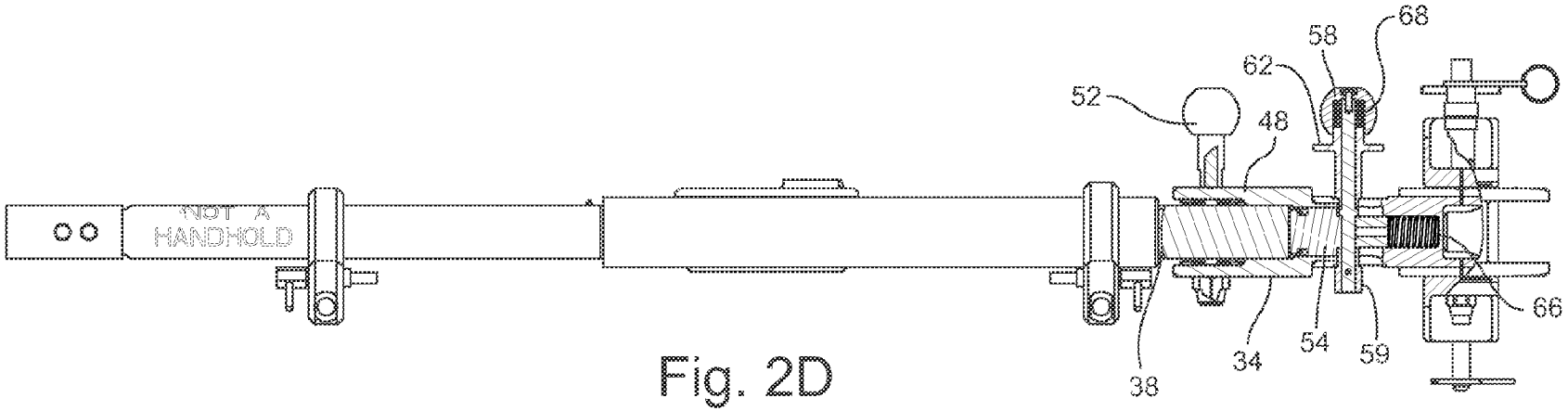
FIG. 2D is a view similar to FIG. 2C, with the locking plunger in the fully locked position.
Figure 2E:
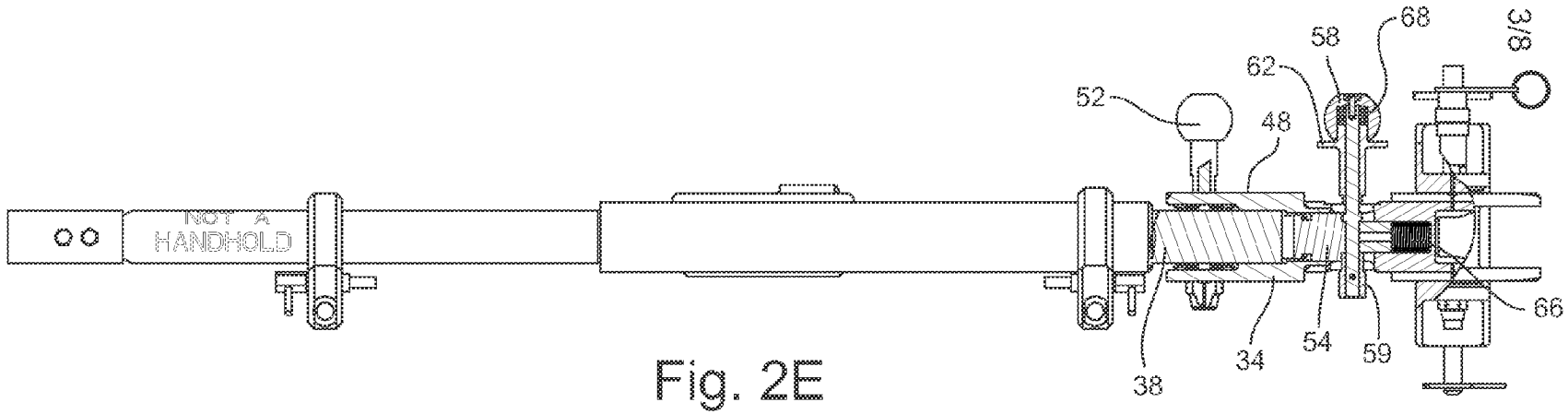
FIG. 2E is a view similar to FIG. 2C, with the locking plunger in a transitional position.
Figure 2F:
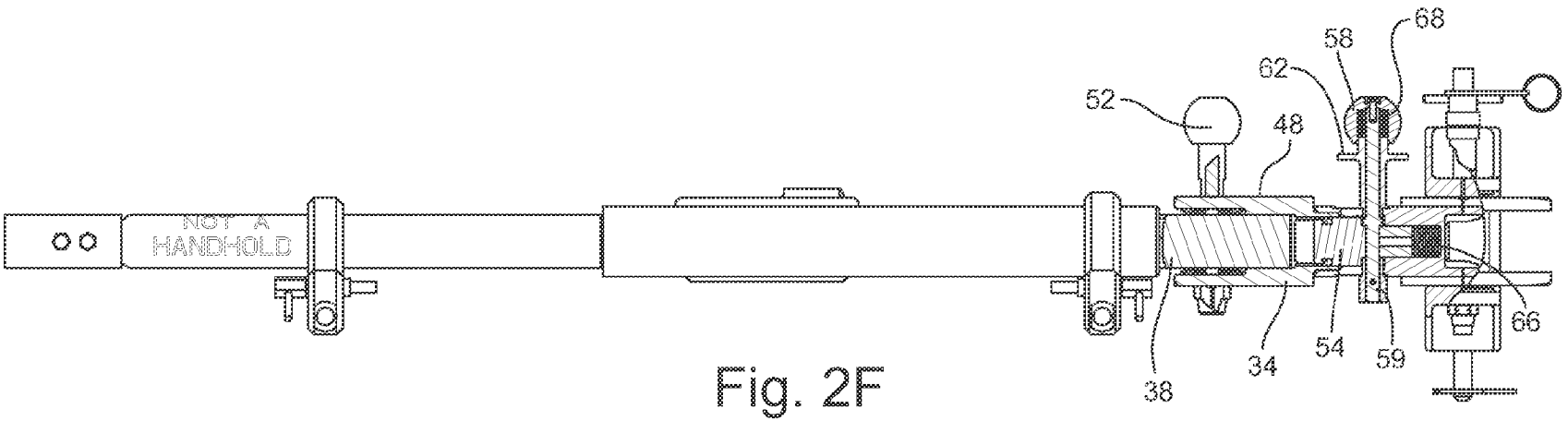
FIG. 2F is a view similar to FIG. 2C, with the locking plunger in the fully unlocked position.

As shown in FIGS. 2C-2F, a locking plunger 54 is disposed in arm 34 and is translatable in arm 34 between a fully locked position (FIG. 2D) and a fully unlocked position (FIG. 2F). FIG. 2E shows locking plunger 54 in a transition position between the fully locked and fully unlocked positions. From its position in FIG. 2C, locking plunger 54 must be translated to the left to reach the fully locked position of FIG. 2D. Locking plunger 54 is biased toward locking mechanism 38 using, for example, a helical compression spring 66. The structure of locking plunger 54 is shown in detail in FIGS. 5A-5F. Locking plunger 54 includes a locking projection 56 configured to engage notches 44*a*, 44*b*, 44*c*, 46 in locking mechanism 38. However, in the fully unlocked position of FIG. 2F, locking projection 56 is translated away from locking mechanism 38 and does not engage any of notches 44*a*, 44*b*, 44*c*, 46.

Figures 6A, 6B, 6C, 6D:
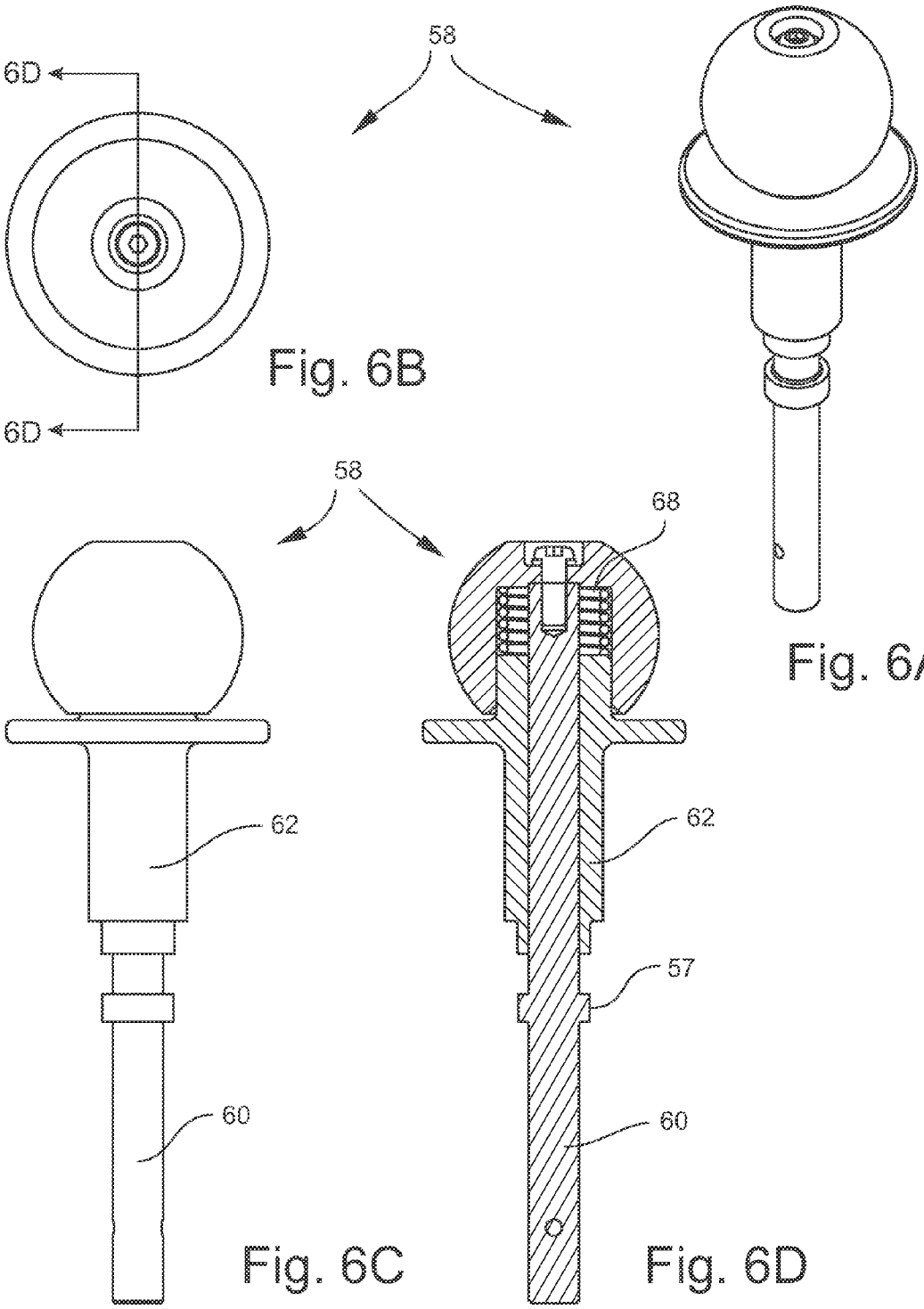
FIG. 6A is a perspective view of an operating pin of the mount of FIG. 1.
FIG. 6B is a top view of FIG. 6A.
FIG. 6C is a side view of FIG. 6B.
FIG. 6D is a side view of FIG. 6C, fully in section, with the sectioned portion taken along the line 6D-6D of FIG. 6B.

As seen in FIGS. 2C-2F, an operating pin 58 is inserted through arm 34 and locking plunger 54. As will be described in more detail below, operating pin 58 is used to translate locking plunger 54 between the positions shown in FIGS. 2C-F. As shown in FIG. 6D, operating pin 58 includes a central shaft 60 and a collar 62 disposed around central shaft 60. Collar 62 is biased toward arm 34 by, for example, a helical compression spring 68. Operating pin 58 is vertically constrained in locking plunger 54. A retainer 59 (FIG. 2C), which may be a collar attached to pin 58 by a spring pin, provides vertical constraint in one direction. An enlarged portion 57 (FIG. 6C) of operating pin 58 provides vertical constraint in the other direction because the outer diameter of enlarged portion 57 is larger than the diameter of the opening 55 (FIG. 5A) that is formed in locking plunger 54 to receive shaft 60 of operating pin 58.

Arm 34 includes an operating pin opening 64 (FIGS. 4A and 4C) for receiving collar 62 of operating pin 58. Opening 64 may be formed in a flat 70 on arm 34. Opening 64 includes fully locked, transition, and fully unlocked portions 72, 74, 76, respectively. The fully locked and fully unlocked portions 72, 76 are large enough in diameter to receive collar 62 of operating pin 58, which is biased downwardly by spring 68. Transition portion 74 is large enough to receive central shaft 60 of operating pin 58 but not large enough to receive collar 62 of operating pin 58. Thus, to move operating pin 58 from, for example, fully locked portion 72, a user lifts collar 62 of pin 58 upward, thereby compressing spring 68. With collar 62 free from fully locked portion 72, pin 58 may be translated to any other portion 74, 76 of opening 64. Translation of pin 58 causes locking plunger 54 to translate the same distance in the same direction. When collar 62 is inserted in fully locked portion 72, arms 26 and 34 cannot rotate with respect to each other. In FIG. 2C, locking plunger 54 is translated to the right, but is not yet fixed in the fully unlocked position. Upon releasing collar 62, collar 62 is pushed downward by spring 68 into fully unlocked portion 76 of opening 64, as shown in FIG. 2F, thereby fixing the fully unlocked position of locking plunger 54.

Figure 3B:
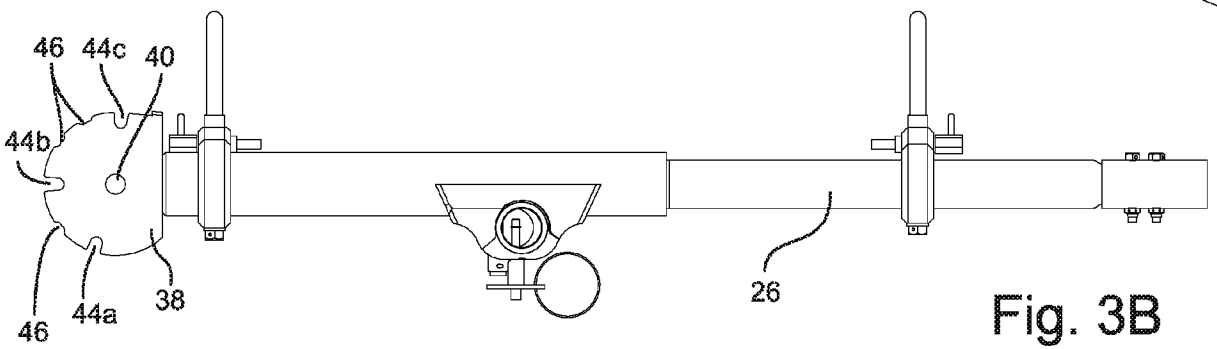
FIG. 3B is a top view of FIG. 3A.
Figure 3C:
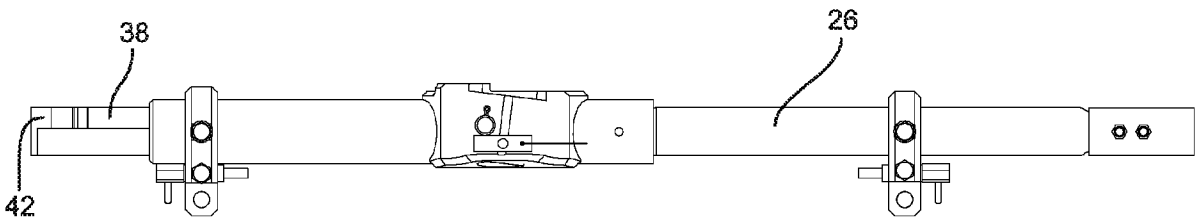
FIG. 3C is a side view of FIG. 3B.

The depth of the notches 44*a*, 44*b*, 44*c*, 46 (FIGS. 3A and 3B) in arcuate outer surface 42 of locking mechanism 38 may be varied so that the extent of translation of locking plunger 54 in the direction of locking mechanism 38 also varies. And, the extent of translation of locking plunger 54 in the direction of locking mechanism 38 affects the position of operating pin 58 in opening 64. For example, in the embodiment shown, only notch 44*b* is deep enough to enable plunger 54 to translate far enough toward locking mechanism 38 to insert collar 62 in fully locked portion 72 of opening 64. Thus, in the positively locked position of mount 10, projection 56 (FIG. 5A) of locking plunger 54 is disposed in notch 44*b* in arcuate outer surface 42 of locking mechanism 38, collar 62 is disposed in fully locked portion 72 of opening 64, and arms 26 and 34 are essentially collinear. In FIG. 1, arms 26 and 34 are essentially collinear, although plunger 54 is not shown in the fully locked position in FIG. 1.

Notches 44*a* and 44*c* are not as deep as notch 44*b* and do not allow plunger 54 to translate far enough toward locking mechanism 38 for collar 62 to fit into fully locked portion 72 of opening 64. Notches 44*a* and 44*c* only allow collar 62 to rest on flat 70 to the right of (as viewed in FIG. 4A) locking portion 72. In gun mount 10, notch 44*a* corresponds to an outboard position of the gun wherein arm 26 is rotated in the direction of arrow O in FIG. 1. Notch 44*c* corresponds to an inboard position of the gun wherein arm 26 is rotated in the direction of arrow I in FIG. 1. Notches 46 are shallower than notches 44*a*, 44*b*, 44*c* and correspond to intermediate force-dampening positions of mount 10. Of course, the number, depth and location of the notches in locking mechanism 38 may be varied for a particular application.

While the invention has been described with reference to certain embodiments, numerous changes, alterations and modifications to the described embodiments are possible without departing from the spirit and scope of the invention as defined in the appended claims, and equivalents thereof.

What is claimed is:

1. An apparatus for rotating and locking a first longitudinal member with respect to a second longitudinal member, the apparatus comprising:

the first longitudinal member with a central axis and, on one end, a locking mechanism, the locking mechanism including a through hole with a central axis that defines a pivot axis of the apparatus, the pivot axis being orthogonal to the central axis of the first longitudinal member, the locking mechanism having a generally arcuate outer surface with a plurality of notches formed therein, the plurality of notches including deep notches and shallow notches;

the second longitudinal member with a yoke on one end, the yoke including through holes;

a pivot pin disposed in the through hole in the locking mechanism and the through holes in the yoke to rotatably fix the first longitudinal member to the second longitudinal member;

a locking plunger disposed in the second longitudinal member and translatable between a fully locked position and a fully unlocked position, the locking plunger being biased toward the locking mechanism and including a projection that (a) engages a first deep notch on the locking mechanism in the fully locked position, (b) engages a shallow notch on the locking mechanism in a force-dampening position, and (c) does not engage the locking mechanism in the fully unlocked position;

an operating pin inserted through the second longitudinal member and the locking plunger for translating the locking plunger between the fully locked and the fully unlocked positions, the operating pin including a central shaft and a collar disposed around the central shaft, the collar being biased toward the second longitudinal member; and an operating pin opening formed in the second longitudinal member for receiving the operating pin, the opening including fully locked, transition, and fully unlocked portions wherein the fully locked and fully unlocked portions are large enough to receive the collar of the operating pin, and the transition portion is large enough to receive the central shaft of the operating pin but not large enough to receive the collar of the operating pin.

2. The apparatus of claim 1, wherein when the projection engages the first deep notch on the locking mechanism in the fully locked position, the first and second longitudinal members are collinear and the collar of the operating pin is disposed in the fully locked portion of the operating pin opening in the second longitudinal member.

3. The apparatus of claim 2, wherein when the projection engages the shallow notch in the locking mechanism in the force-dampening position, the central shaft of the operating pin is disposed in the transition portion of the operating pin opening in the second longitudinal member.

4. The apparatus of claim 3, wherein the first and second longitudinal members are arms and the first arm includes a pintle and a gun cradle fixed to the pintle.

5. The apparatus of claim 4, wherein the deep notches include second and third deep notches disposed on opposite sides of the first deep notch.

6. The apparatus of claim 5, wherein the second and third deep notches are not as deep as the first deep notch.

7. The apparatus of claim 6, wherein at least one shallow notch is disposed between the first deep notch and the second deep notch and at least one shallow notch is disposed between the first deep notch and the third deep notch.

8. The apparatus of claim 2, further comprising a flat formed on the second longitudinal member around the operating pin opening.

9. The apparatus of claim 8, further comprising a spring that biases the locking plunger toward the locking mechanism.

10. The apparatus of claim 8, further comprising a spring that biases the collar toward the second longitudinal member.

11. The apparatus of claim 2, further comprising at least one retainer that restrains movement of the operating pin in the locking plunger in a direction parallel to the pivot axis.

* * * * *